US008556359B1

(12) United States Patent
Gorgievski

(10) Patent No.: US 8,556,359 B1
(45) Date of Patent: Oct. 15, 2013

(54) REFRIGERATOR DOOR LOCKING ASSEMBLY

(76) Inventor: Kire Gorgievski, Green Valley (AU)

( * ) Notice: Subject to any disclaimer, the term of this patent is extended or adjusted under 35 U.S.C. 154(b) by 0 days.

(21) Appl. No.: 13/456,770

(22) Filed: Apr. 26, 2012

(51) Int. Cl.
*A47B 96/04* (2006.01)

(52) U.S. Cl.
USPC ..... 312/405; 312/218

(58) Field of Classification Search
USPC ..... 312/405, 216–218, 332.1, 406; 49/394, 49/395; 292/11, 24, 25, 31, 44, 45, 54, 56, 292/116, 117, 120, 101–103, 108, 213, 241, 292/218, 195, 202–204, 210, 341.15, 292/341.17, DIG. 11, DIG. 71
See application file for complete search history.

(56) References Cited

U.S. PATENT DOCUMENTS

| | | | | | |
|---|---|---|---|---|---|
| 619,928 | A | * | 2/1899 | Bigelow | 312/209 |
| 1,285,209 | A | * | 11/1918 | Jones | 312/107.5 |
| 1,835,100 | A | * | 12/1931 | Symington | 292/218 |
| 2,180,630 | A | * | 11/1939 | Hearn | 312/218 |
| 2,597,684 | A | * | 5/1952 | Stringe | 312/333 |
| 3,194,190 | A | * | 7/1965 | Harger | 109/63.5 |
| 3,407,535 | A | * | 10/1968 | Purkey | 49/280 |
| 3,442,563 | A | * | 5/1969 | Scroop | 312/405 |
| 3,621,684 | A | * | 11/1971 | Horvay et al. | 70/73 |
| 3,631,644 | A | * | 1/1972 | Mazza | 312/406 |
| 4,024,494 | A | | 5/1977 | Quesnel | |
| 4,067,444 | A | * | 1/1978 | Wilson | 211/126.15 |
| 4,132,440 | A | * | 1/1979 | Johnson | 292/341.19 |
| 4,306,431 | A | * | 12/1981 | Craig | 70/79 |
| 4,629,263 | A | * | 12/1986 | Hendriks | 312/216 |
| 4,790,610 | A | * | 12/1988 | Welch et al. | 312/218 |
| 4,804,876 | A | * | 2/1989 | Lannert et al. | 312/221 |
| 5,016,453 | A | | 5/1991 | Bonnice et al. | |
| 5,040,857 | A | * | 8/1991 | Mandel et al. | 312/405 |
| 5,199,282 | A | * | 4/1993 | Wang | 70/38 A |
| 5,265,921 | A | | 11/1993 | Nikitas et al. | |
| 5,275,029 | A | | 1/1994 | Myers | |
| D344,442 | S | | 2/1994 | Myers | |
| 5,358,293 | A | | 10/1994 | Bradley, Jr. et al. | |
| 5,588,687 | A | | 12/1996 | Pinkerton | |
| 6,257,154 | B1 | * | 7/2001 | Kasper | 109/73 |
| 7,798,542 | B2 | | 9/2010 | Frazier et al. | |
| 2003/0094025 | A1 | | 5/2003 | Dallman | |

* cited by examiner

*Primary Examiner* — Hanh V Tran

(57) ABSTRACT

A refrigerator door locking assembly is provided for selectively locking and unlocking refrigerator and freezer doors. The assembly includes a cabinet having a perimeter wall. An outer edge of the perimeter wall defines an open face into the cabinet. A first door is pivotally coupled to the cabinet selectively covering the open face. A conduit extends through the perimeter wall of the cabinet. The conduit has an upper end and a lower end. A first slit extends through the outer edge of the perimeter wall into the conduit. A first hook is coupled to the door and is inserted through the first slit into the conduit when the first door is in a closed position covering the open face. A rod is coupled to the cabinet and positioned in the conduit. The rod selectively engages the first hook whereby the first door is held in the closed position.

8 Claims, 3 Drawing Sheets

REFRIGERATOR DOOR LOCKING ASSEMBLY

BACKGROUND OF THE DISCLOSURE

1. Field of the Disclosure

The disclosure relates to door locking devices and more particularly pertains to a new door locking device for selectively locking and unlocking refrigerator and freezer doors.

2. Summary of the Disclosure

An embodiment of the disclosure meets the needs presented above by generally comprising a cabinet having a perimeter wall. An outer edge of the perimeter wall defines an open face into the cabinet. A first door is pivotally coupled to the cabinet selectively covering the open face. A conduit extends through the perimeter wall of the cabinet. The conduit has an upper end and a lower end. A first slit extends through the outer edge of the perimeter wall into the conduit. A first hook is coupled to the door and is inserted through the first slit into the conduit when the first door is in a closed position covering the open face. A rod is coupled to the cabinet and positioned in the conduit. The rod selectively engages the first hook whereby the first door is held in the closed position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
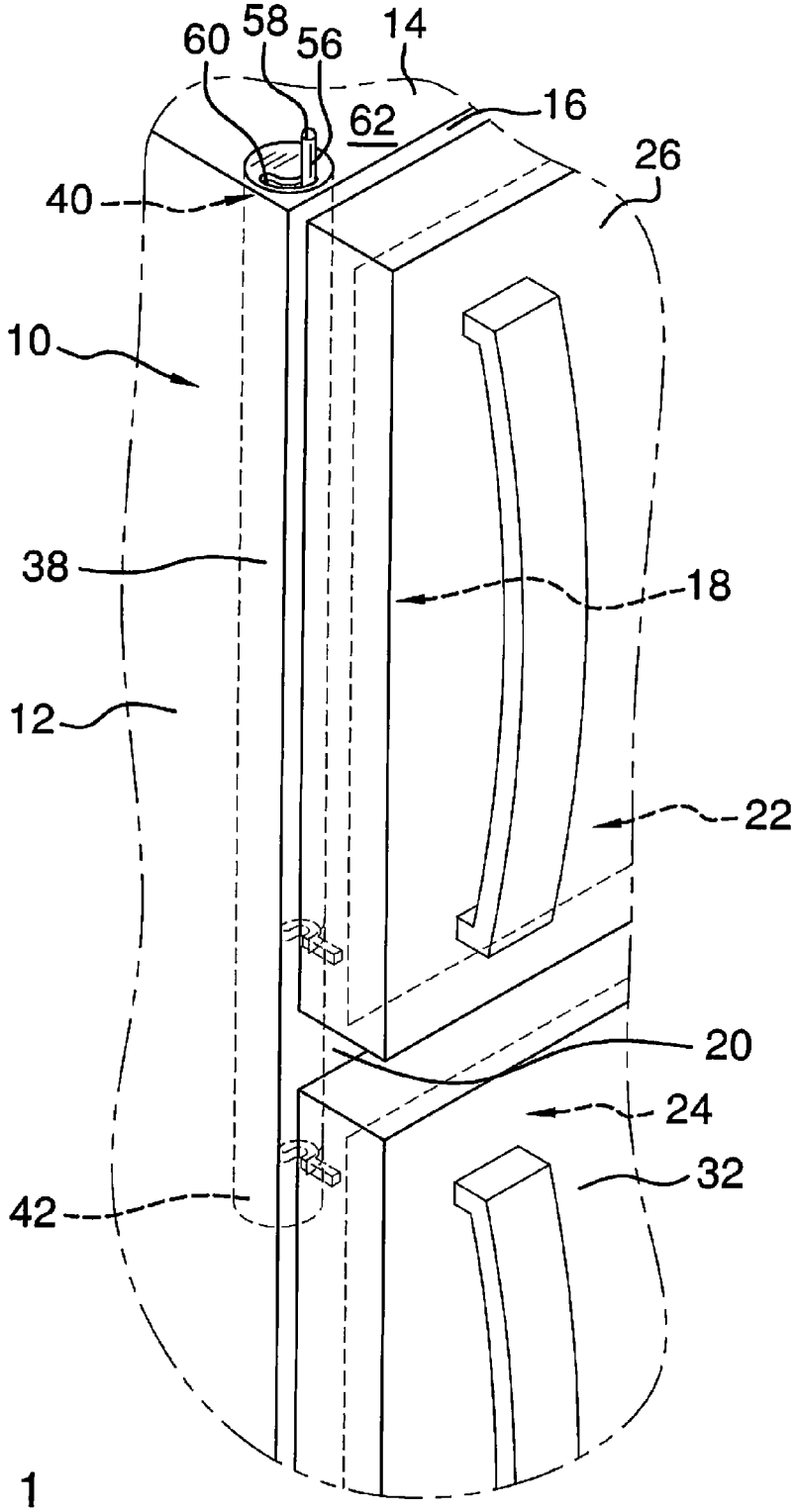
FIG. 1 is a top front side perspective view of a refrigerator door locking assembly according to an embodiment of the disclosure.
Figure 2:
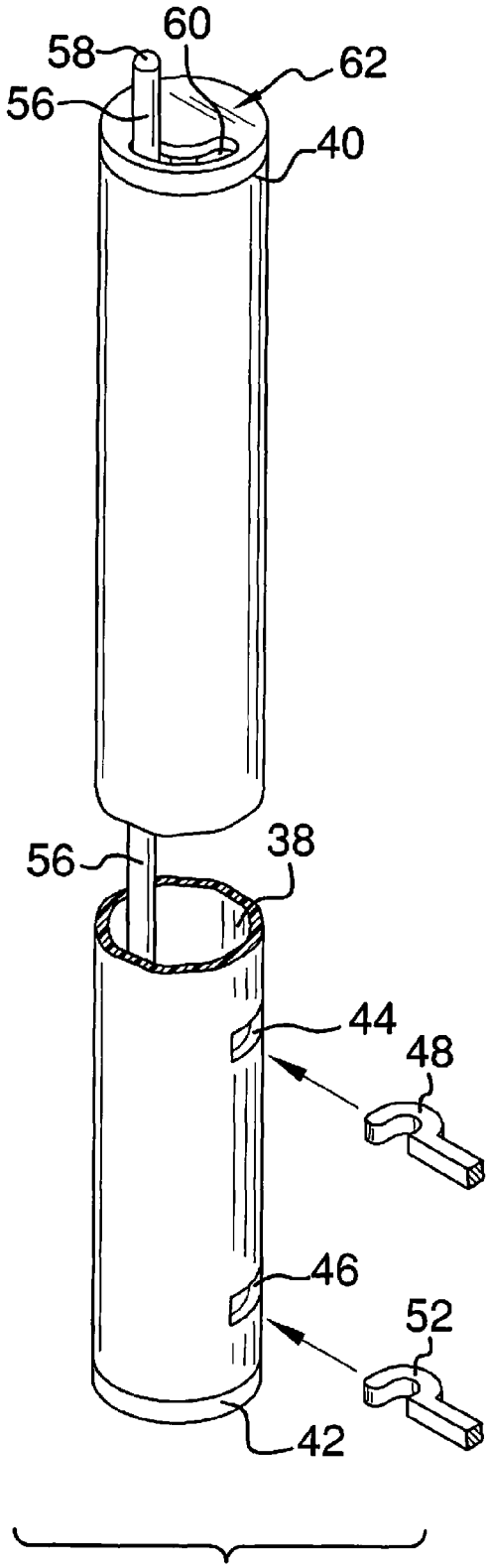
FIG. 2 is a partial cut-away top front side perspective view of an embodiment of the disclosure.
Figure 3:
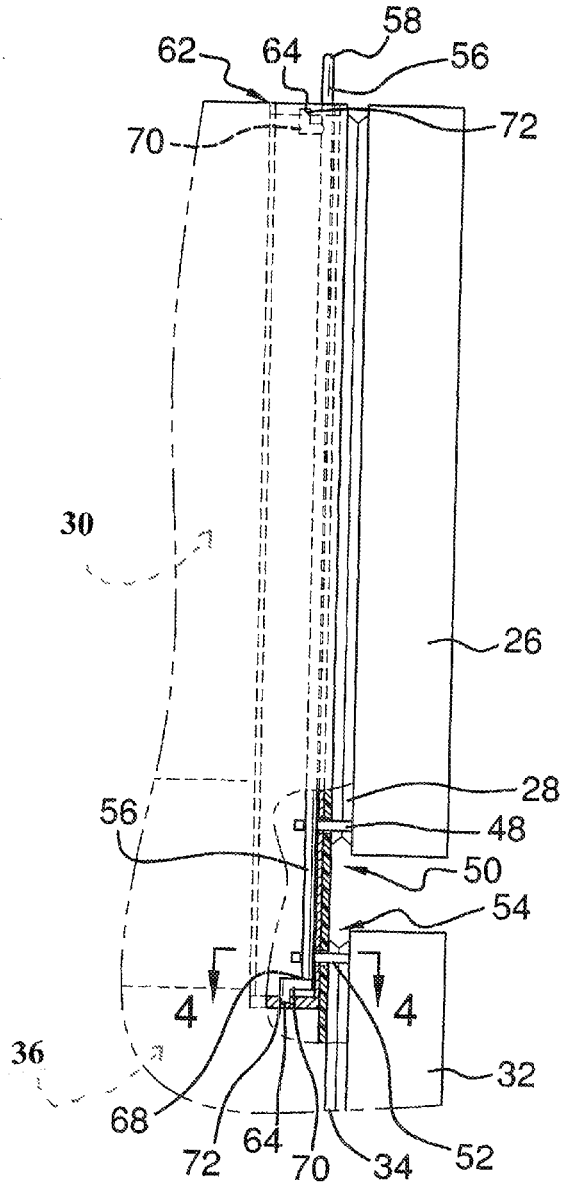
FIG. 3 is a partial cut-away side view of an embodiment of the disclosure.
Figure 4:
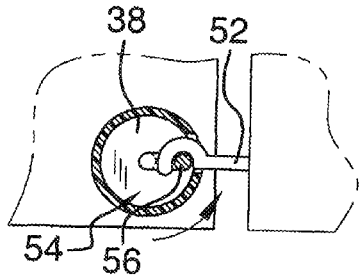
FIG. 4 is a cross-sectional view of an embodiment of the disclosure taken along line 4-4 of FIG. 3 showing a locked position.
Figure 5:
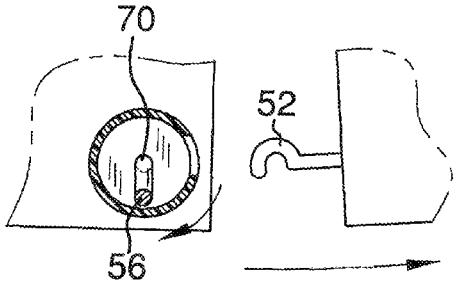
FIG. 5 is a cross-sectional view of an embodiment of the disclosure taken along line 4-4 of FIG. 3 showing an unlocked position.

With reference now to the drawings, and in particular to FIGS. 1 through 5 thereof, a new door locking device embodying the principles and concepts of an embodiment of the disclosure and generally designated by the reference numeral 10 will be described.

As best illustrated in FIGS. 1 through 5, the refrigerator door locking assembly 10 generally comprises a cabinet 12 having a perimeter wall 14. An outer edge 16 of the perimeter wall 14 defines an open face 18. An interior wall 20 extends horizontally across and through the cabinet 12. The interior wall 20 divides the open face 18 into an upper portion 22 and a lower portion 24. A first door 26 is pivotally coupled to the cabinet 12. The first door 26 selectively covers the upper portion 22 of the open face 18. A first seal 28 is coupled to the first door 26 and abuts the perimeter wall 14 and interior wall 20 such that an upper interior space 30 of the cabinet 12 extending inwardly from the upper portion 22 of the open face 18 may be refrigerated. A single compartment may be provided in which case the first seal 28 extends around the outer edge 16 of the perimeter wall 14.

A second door 32 is pivotally coupled to the cabinet 12 selectively covering the lower portion 24 of the open face 18. A second seal 34 is coupled to the second door 32 and abuts the perimeter wall 14 and the interior wall 20 such that a lower interior space 36 of the cabinet 12 extending inwardly from the lower portion 24 of the open face 18 may be refrigerated.

A conduit 38 extends vertically through the perimeter wall 14 of the cabinet 12. The conduit 38 has an upper end 40 and a lower end 42. The lower end 42 may be positioned adjacent to the lower portion 24 of the open face 18. A first slit 44 extends through the outer edge 16 of the perimeter wall 14. The first slit 44 extends into the conduit 38 adjacent to the upper portion 22 of the open face 18. A second slit 46 extends through the outer edge 16 of the perimeter wall 14 and into the conduit 38 adjacent to the lower portion 24 of the open face 18. A first hook 48 is coupled to the first door 26. The first hook 48 is inserted through the first slit 44 and into the conduit 38 when the first door 26 is in a closed position 50 covering the upper portion 22 of the open face 18. A second hook 52 is coupled to the second door 32. The second hook 52 is inserted through the second slit 46 and into the conduit 38 when the second door 32 is in a closed position 54 covering the lower portion 24 of the open face 18.

A rod 56 is coupled to the cabinet 12. The rod 56 is positioned in the conduit 38 where the rod 56 selectively engages the first hook 48 and the second hook 52. Thus, each of the first door 26 and the second door 32 are held in the closed positions 50,54. The rod 56 has an upper end 58 extending outwardly through an arcuate slot 60 in the perimeter wall 14 of the cabinet 12 such that the upper end 58 extends through a top surface 62 of the cabinet 12.

A pair of aligned recesses 64 is provided with each being positioned in opposite ends 66,68 of the conduit 38. A pair of spaced arms 70 is coupled to and extends from the rod 56. The arms 70 are pivotally coupled to the cabinet 12 in the conduit 38 whereby the rod 56 is rotatable within the conduit 38 offset from an axis of rotation. Each of the spaced arms 70 is L-shaped and has a distal end 72 positioned in an associated one of the recesses 64.

In use, the upper end 58 of the rod 56 is manipulated to clear the rod 56 from the first hook 48 and, when utilized with a two compartment refrigerator-freezer, the second hook 52. The first door 26 and second door 32 may then be opened if desired. After closing the first door 48 and the second door 52, the upper end 58 of the rod 56 is moved to engage the rod 56 to the first hook 48 and the second hook 52.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A door locking assembly comprising:

a cabinet having a perimeter wall, an outer edge of said perimeter wall defining an open face;

a first door pivotally coupled to said cabinet, said first door selectively covering said open face;

a conduit extending through said perimeter wall of said cabinet, said conduit having an upper end and a lower end;

a first slit extending through said outer edge of said perimeter wall, said first slit extending into said conduit;

a first hook coupled to said door, said first hook being inserted through said first slit and into said conduit when said first door is in a closed position covering said open face; and a rod coupled to said cabinet, said rod being positioned in said conduit, said rod selectively engaging said first hook whereby said first door is held in said closed position, a pair of spaced arms coupled to and extending substantially perpendicular from said rod, said arms being pivotally coupled to said cabinet in said conduit to define an axis of rotation whereby said rod is rotatable within said conduit offset from said axis of rotation, said rod having an upper end extending outwardly through said cabinet such that said rod is manually rotatable by said upper end to selectively lock and unlock said first door relative to said cabinet.

2. The assembly of claim 1, further including said upper end of said rod extending outwardly through a slot in said perimeter wall of said cabinet.

3. The assembly of claim 2, further including said slot being arcuate.

4. A door locking assembly comprising:

a cabinet having a perimeter wall, an outer edge of said perimeter wall defining an open face;

an interior wall extending through said cabinet, said interior wall dividing said open face into an upper portion and a lower portion;

a first door pivotally coupled to said cabinet, said first door selectively covering said upper portion of said open face;

a second door pivotally coupled to said cabinet, said second door selectively covering said lower portion of said open face;

a conduit extending through said perimeter wall of said cabinet, said conduit having an upper end and a lower end, said lower end being positioned adjacent to said lower portion of said open face;

a first slit extending through said outer edge of said perimeter wall, said first slit extending into said conduit adjacent to said upper portion of said open face;

a second slit extending through said outer edge of said perimeter wall, said second slit extending into said conduit adjacent to said lower portion of said open face;

a first hook coupled to said first door, said first hook being inserted through said first slit and into said conduit when said first door is in a closed position covering said upper portion of said open face;

a second hook coupled to said second door, said second hook being inserted through said second slit and into said conduit when said second door is in a closed position covering said lower portion of said open face; and a rod coupled to said cabinet, said rod being positioned in said conduit, said rod selectively engaging said first hook and said second hook whereby each of said first door and said second door are held in said closed position, a pair of spaced arms coupled to and extending substantially perpendicular from said rod, said arms being pivotally coupled to said cabinet in said conduit to define an axis of rotation whereby said rod is rotatable within said conduit offset from said axis of rotation, said rod having an upper end extending outwardly through said cabinet such that said rod is manually rotatable by said upper end to selectively lock and unlock said first door and said second door relative to said cabinet.

5. The assembly of claim 4, further including said upper end of said rod extending outwardly through a slot in said perimeter wall of said cabinet.

6. The assembly of claim 5, further including said slot being arcuate.

7. The assembly of claim 4, further comprising:

a pair of aligned recesses positioned in opposite ends of said conduit; and each of said spaced arms being L-shaped, a distal end of each of said arms being positioned in an associated one of said recesses.

8. A door locking assembly comprising:

a cabinet having a perimeter wall, an outer edge of said perimeter wall defining an open face;

an interior wall extending through said cabinet, said interior wall dividing said open face into an upper portion and a lower portion;

a first door pivotally coupled to said cabinet, said first door selectively covering said upper portion of said open face;

a second door pivotally coupled to said cabinet, said second door selectively covering said lower portion of said open face;

a conduit extending through said perimeter wall of said cabinet, said conduit having an upper end and a lower end, said lower end being positioned adjacent to said lower portion of said open face;

a first slit extending through said outer edge of said perimeter wall, said first slit extending into said conduit adjacent to said upper portion of said open face;

a second slit extending through said outer edge of said perimeter wall, said second slit extending into said conduit adjacent to said lower portion of said open face;

a first hook coupled to said first door, said first hook being inserted through said first slit and into said conduit when said first door is in a closed position covering said upper portion of said open face;

a second hook coupled to said second door, said second hook being inserted through said second slit and into said conduit when said second door is in a closed position covering said lower portion of said open face;

a rod coupled to said cabinet, said rod being positioned in said conduit, said rod selectively engaging said first hook and said second hook whereby each of said first door and said second door are held in said closed position, said rod having an upper end extending outwardly through an arcuate slot in said perimeter wall of said cabinet;

a pair of aligned recesses positioned in opposite ends of said conduit; and a pair of spaced arms coupled to and extending substantially perpendicular from said rod, said arms being pivotally coupled to said cabinet in said conduit to define an axis of rotation whereby said rod is rotatable within said conduit offset from said axis of rotation, each of said spaced arms being L-shaped, a distal end of each of said arms being positioned in an associated one of said recesses, said upper end of said rod extending outwardly through said cabinet such that said rod is manually rotatable by said upper end to selectively lock and unlock said first door and said second door relative to said cabinet.

* * * * *